United States Patent [19]

Neider et al.

[11] Patent Number: 4,972,087

[45] Date of Patent: Nov. 20, 1990

[54] SHIPPING CONTAINER FOR LOW LEVEL RADIOACTIVE OR TOXIC MATERIALS

[75] Inventors: Tara J. Neider, Washingtonville; Michael P. Walsh, Valhalla, both of N.Y.; Alfred G. Eggers, New Fairfield, Conn.

[73] Assignees: Transnuclear, Inc., Hawthorne, N.Y.; Pullman Power Products Corp., Williamsport, Pa.

[21] Appl. No.: 331,641

[22] Filed: Aug. 5, 1988

[51] Int. Cl.[5] ..... G21F 5/00

[52] U.S. Cl. ..... 250/507.1

[58] Field of Search ..... 376/272; 250/506.1, 250/507.1; 252/633; 220/85 K, 256, 327, 415, 466

[56] References Cited

U.S. PATENT DOCUMENTS

| | | | |
|---|---|---|---|
| 2,100,309 | 11/1937 | Bender | 220/408 |
| 3,226,467 | 12/1965 | Kienel et al. | 277/53 |
| 3,608,769 | 9/1971 | Gablin | 220/441 |
| 3,982,134 | 9/1976 | Housholder et al. | 250/506.1 |
| 4,116,337 | 9/1978 | Backus | 206/591 |
| 4,175,669 | 11/1979 | Housholder et al. | 250/506.1 |
| 4,447,729 | 5/1984 | Doroszlai et al. | 250/507.1 |
| 4,456,827 | 6/1984 | Botzem et al. | 376/272 |
| 4,535,250 | 8/1985 | Fields | 250/507.1 |
| 4,599,518 | 7/1986 | Schmidt et al. | 250/507.1 |
| 4,636,645 | 1/1987 | Kessinger | 250/506.1 |
| 4,862,007 | 8/1989 | Mallory | 376/272 |

*Primary Examiner*—Daniel D. Wasil

*Attorney, Agent, or Firm*—Banner, Birch, McKie & Beckett

[57] ABSTRACT

A shipping container for transporting hazardous materials, for example toxic chemicals or low level radioactive waste materials, such as contaminated clothing worn by workers at nuclear power plants, is provided. The shipping container is a double-walled containment vessel which includes an inner container securably nesting within an outer container. Both the inner container and outer containers have thin metal walls which absorb energy from impacts by deforming. The shipping container has a port for sampling the atmosphere between the inner and outer containers in order to test for leakage of hazardous materials from the inner container. A heat shield at least partially surrounds the outer container. Wooden impact absorbers are also provided around both ends of the shipping container. The shipping container is light weight because of the relatively thin metallic walls and provides a leak-tight enclosure in which hazardous materials may be safely stored during transit to permanent disposal site.

15 Claims, 2 Drawing Sheets

SHIPPING CONTAINER FOR LOW LEVEL RADIOACTIVE OR TOXIC MATERIALS

BACKGROUND OF THE INVENTION

1. Field of the Invention

The present invention relates to a shipping container for transporting highly toxic waste materials or radioactive waste materials which emit low and/or medium levels of radiation. In particular, the present invention relates to a light weight and leak-tight shipping container for transporting said materials in a safe and efficient manner.

2. Description of the Prior Art

Shipping containers which are used to transport nuclear waste materials, for example waste materials containing plutonium in excess of 20 curies per package, as specified by the Nuclear Regulatory Commission of the United States Government in 10 C.F.R. § 71, must be packaged in a separate inner container placed within an outer container. Both the inner and outer containers must be sealed in a leak-tight manner so that no radioactive particles or gases are released during transit. The shipping containers must be highly resistant to impact, puncture, penetration, fires or shocks. For example, the Nuclear Regulatory Commission has instituted certain tests in order to qualify a shipping container as satisfactory for shipping low/medium level radioactive (e.g., transuranic) waste materials. These tests are rather severe and in general they comprise:

1. A thirty foot drop test onto an essentially unyielding surface;
2. A forty inch drop test onto a six inch diameter steel bar;
3. A fire test at 1475° F. for thirty minutes; and
4. A water immersion test.

Prior art shipping containers to date have generally been designed to provide shielding against the emissions of high level radioactive materials, such as nuclear fuel, and to withstand the severe stresses imposed by the physical tests mentioned above. Even so, the prior art has not provided a container which is light weight, and therefore economical to ship, and which provides the high level of containment and leak-tightness as required by the NRC regulations for transporting transuranic waste.

Therefore, there has been a need for a shipping container which can meet the stringent NRC requirements for shipping low and medium level nuclear waste materials, or other toxic waste materials, and which is light weight, easy to construct and economical to ship.

SUMMARY OF THE INVENTION

It is an object of the present invention to provide an improved shipping container which is particularly well adapted for transporting low and medium level radioactive (e.g., transuranic) waste or other toxic materials such as toxic chemicals.

It is another object of the present invention to provide a shipping container having a high degree of resistance to puncture, penetration and thermal effects, and good leak-tightness and water tightness.

These and other objects of the present invention are met by a double containment shipping container for transporting hazardous materials. The shipping container comprises a cylindrically shaped outer container having dish-shaped heads and thin deformable metallic walls. The outer container includes a first portion and a second portion and closure means for securing said first and second portions together in a leak-tight manner. The outer container has a recessed area in a wall thereof. Means are provided for preventing the first and second portions from shifting relative to one another when the outer container is securely closed. The shipping container also includes an inner container having thin deformable metallic walls and a size and shape adapted to nest within the outer container. The inner container includes a first part and a second part and closure means for securing said first and second parts together in a leak-tight manner. Means are provided for securably nesting the inner container within the outer container. The recessed area in the outer container includes a port for sampling the atmosphere between the inner and outer containers. The shipping container includes a heat shield at least partially surrounding the outer container. Also provided are impact absorbers positioned around the dish-shaped ends of the outer container. The impact absorbers contain wood as the impact absorbing material.

DETAILED DESCRIPTION

The shipping container of the present invention is particularly well-suited for shipping hazardous materials such as etiologic agents, oxidizing agents, flammables, corrosive liquids, explosives, other hazardous chemicals, or nuclear materials such as transuranic wastes. When used to ship nuclear materials, it is important to note that the shipping container of the present invention provides excellent containment of the nuclear material but only minimal shielding against radiation.

Figure 1:
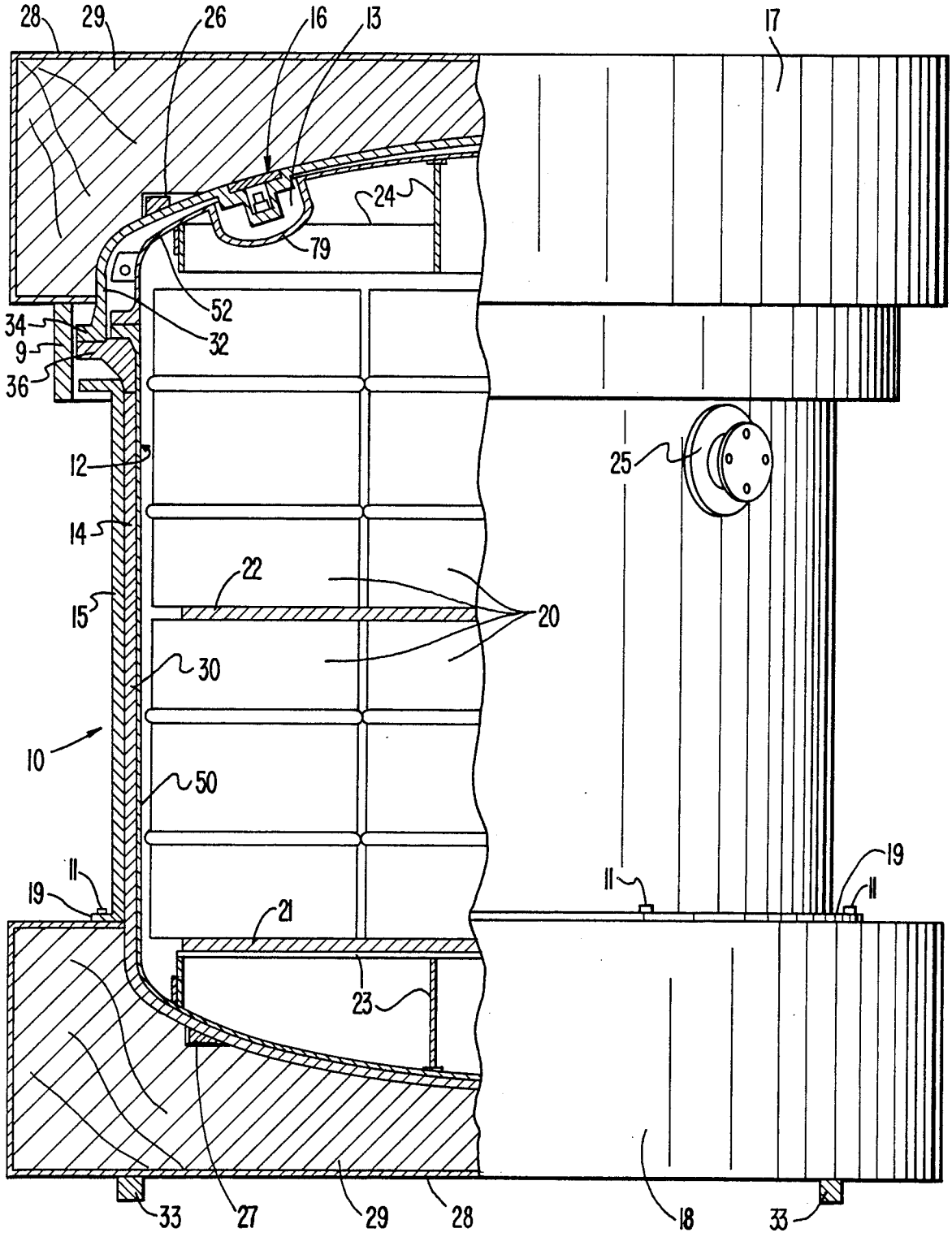
FIG. 1 is a side view, partly in section, of a shipping container according to one embodiment of the present invention.

Referring to FIG. 1, there is shown a partial cut-away side sectional view of a shipping container 10 according to the present invention. The shipping container 10 is a double containment vessel comprising an inner container 12 and an outer container 14. Both the inner container 12 and the outer container 14 include two closable parts or portions, respectively. These parts or portions are flanged and adapted to be closed in a leak-tight manner as will be described in more detail hereinafter.

Both the inner container 12 and the outer container 14 have a generally cylindrical shape with dish-shaped (convexly curved) ends. The inner container 12 preferably has a size and shape adapted to contain a plurality of secondary material containers, such as drums 20. Drums 20 are typically 55 gallon drums which can be used, for example, to collect low level radioactive waste materials at the plant site. Examples of low level radioactive waste materials which may be safely shipped in container 10 include, without limitation, cloth, paper, plastics, glass, metals, sludges, earth, liquids and other materials which have become contaminated with radioactive nuclides. The drums 20 are closed and then loaded into the inner container 12. To facilitate loading of the drums, support structures 23, 24 are preferably provided as well as drum spacing members 21, 22. Spacing member 21, 22 are preferably composed of wood, foam or other suitable shock absorbing material. The shipping container is designed to be loaded and shipped in the vertical orientation shown in FIG. 1. This also provides easy access for opening the inner and outer containers 12, 14 for unloading the drums 20 therefrom.

A recessed test port 16 is provided in one of the dish-shaped ends of outer container 14. Test port 16 is used to test the atmosphere in the enclosed space 13 between the inner container 12 and the outer container 14 as will be explained in more detail hereinafter.

In order to withstand the stresses imposed by the thirty foot drop test, the ends of the shipping container 10 are provided with impact absorbers 17, 18. Each of the impact absorbers 17, 18 preferably comprises a metal casing 28 surrounding an impact absorbing core 29. The impact absorbing material used as the cores 29 is wood. Preferably, balsa wood and/or redwood is used as the impact absorbing material. The wooden impact absorber 17 is held in place around the dish-shaped end of outer container 14 by a plurality of high strength bolts (not shown) which are anchored in the flanges 34, 36 of the outer container 14. The impact absorber 18 is maintained in place around the other dish-shaped end of outer container 14 by a plurality of bolts 11 which are anchored in ring 19 which is in turn welded onto outer container 14. A ring 26 is welded onto outer container portion 32. Ring 26 prevents impact absorber 17 from shifting laterally during the 30 foot drop test. A similar ring 27 is provided at the bottom of container 14 to prevent shifting of impact absorber 18.

A heat shield 15 is also provided around the central portion of the outer container 14. Shield 15 preferably has a sandwich type construction with a central insulating layer, for example a central layer composed of a ceramic fiber type thermal insulation or similar material, encased in stainless steel or other metal layers. The shield 15 may be secured to the flanges 34, 36 by a plurality of fastening bolts (not shown). A similar heat shield 9 is preferably disposed adjacent flanges 34, 36.

One or more trunnions 25, which are welded to the outer container 14 and extend through holes in the heat shield 15, may be used to facilitate tying down the shipping container 10 onto a truck or rail car bed.

A wood ring 33 is provided at the very bottom of container 10 for absorbing slight impacts caused by normal handling of the container 10.

In order to withstand the stresses imposed by dropping the shipping container 10 onto a six inch diameter bar from a height of forty inches, the walls of both the inner and outer containers 12, 14 must be thin enough and deformable enough to absorb the energy of the dropping container through deformation of the inner and outer container walls. For these purposes, the walls of the outer container 14 may have a thickness in the range of about ½ to 2 inches, and preferably, a thickness of about ¾ inches. Similarly, the inner container 12 has a wall thickness in the range of ⅛ to ½ inch and preferably about ¼ inch. By providing inner and outer containers 12, 14 having wall thicknesses in these size ranges, the container 10 is able to withstand the stresses of the 40 inch drop onto a puncture bar test through deformation of the inner and outer container walls. This is substantially unlike the prior art containers which had a very heavy construction, on the order of about an 8 to 12 inch wall thickness. The prior art containers used mass to deform the puncture bar and thereby resist the effects of the 40 inch drop test. The thinner inner and outer container walls used in the present invention safely deform and also make the shipping container 10 substantially lighter in weight and therefore more economical to ship. A further advantage of the light weight shipping container 10 is that no special overweight shipping permits are required from those states through which the containers are transported by truck. Most preferably, the outer container walls are composed of stainless steel. The inner container walls are also preferably composed of stainless steel.

Figure 2:
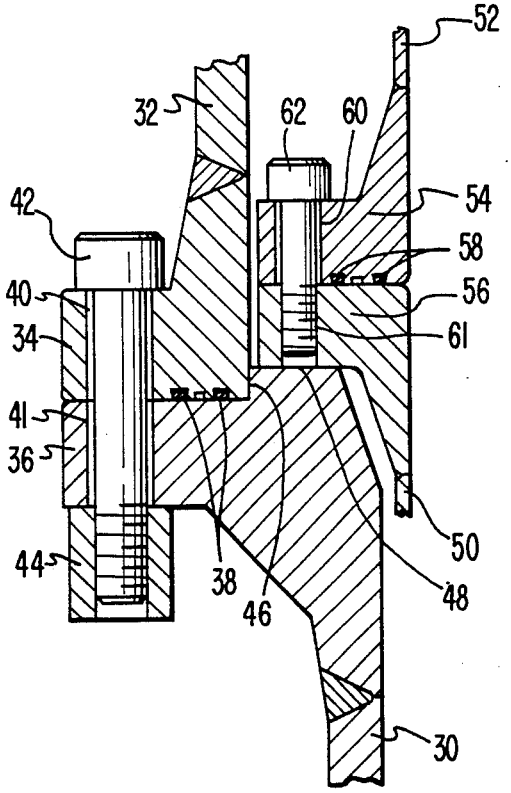
FIG. 2 is a side sectional view of a portion of the shipping container shown in FIG. 1, illustrating where the top and bottom portions of the outer container, and the top and bottom parts of the inner container, are secured together.
Figure 3:
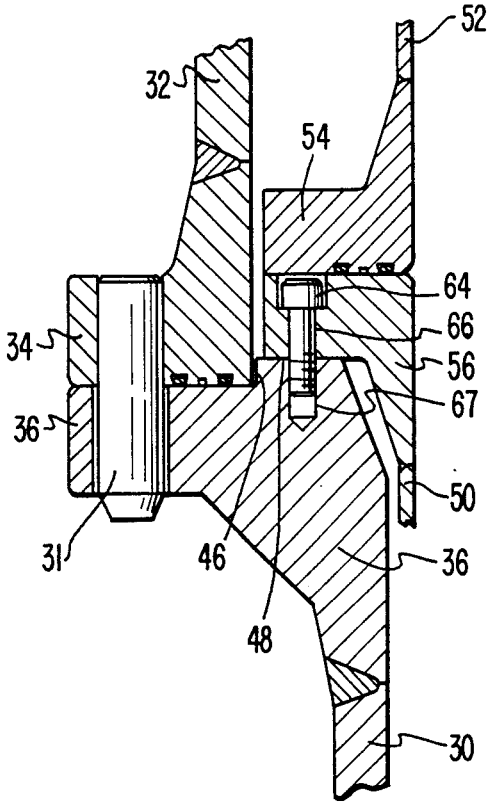
FIG. 3 is a side sectional view of a portion of the shipping container shown in FIG. 1, illustrating the means for orienting and securably nesting the inner container within the outer container.

Turning now to FIGS. 2 and 3, there is illustrated the region where the inner and outer containers are fastened together and where the inner container nests within the outer container. Inner container 12 comprises a first or bottom portion 50 and a second or top portion 52. Portion 50 has a circumferential flange 56 welded to the upper end thereof. Similarly, portion 52 has a circumferential flange 54 welded to the bottom portion thereof. Flange 54 has a plurality of holes 60 drilled therethrough. The holes 60 extend around the entire circumference of flange 54. Likewise, flange 56 has a plurality of holes 61 drilled therethrough. The two sets holes 60 and 61 are spaced around the circumferences of flanges 54, 56 so that the two sets of holes 60, 61 line up with one another when the flanges 54, 56 are properly aligned. The two flanges 54, 56 are secured together by a plurality of bolts 62 extending through holes 60, 61 in a known manner. Preferably, two or more O-ring seals 58 are provided in the flange 54. Once the inner container parts 50, 52 are fastened together with the plurality of bolts 62, the O-rings 58 make the closed inner container 12 leak-tight. The term "leak-tight" as used herein is defined under ANSI Standard No. 14.7 as a leakage rate of less than $1\times10^{-7}$ standard $cm^3$ of air/atm-sec.

The outer container 14 has a similar construction. The outer container 14 includes a first or bottom portion 30 and a second or top portion 32. Portion 30 has a circumferentil flange 36 welded onto the upper end thereof. Similarly, portion 32 has a circumferential flange 34 welded onto the lower end thereof. Flange 34 is provided with a plurality of drilled holes 40 around the circumference thereof. Likewise, flange 36 is provided with a plurality of drilled holes 41 around the circumference thereof. The number and spacing of holes 40, 41 is such that the holes 40, 41 are adapted to line up with one another when flanges 34, 36 are properly aligned. The two sets of holes 40, 41 accommodate a plurality of fastening bolts 42. Two or more alignment pins 31 may be placed in appropriate holes along the circumference of flanges 34, 36 to assist the workers in finding the proper alignment of the flanges 34, 36 to insert the bolts 42. Preferably, a threaded boss 44 is secured (i.e., by welding) below each hole 41 in the flange 36. This allows the use of longer fastening bolts 42 which are more resistant to bending stresses.

The flange 34 is also provided with at least two O-rings 38 which provide a leak-tight seal when the upper container portion 32 is secured to the lower container portion 30. The innermost O-ring 38 provides the leak-tight containment seal. The outer O-ring provides a backup, but also allows for simple leak testing of the containment seal. This is accomplished by providing a test groove and a test port (not shown) which provides access to the groove between the two O-ring 38. The groove can be accessed by the test port in order to test the integrity of the inner O-ring 38. Since the groove between the O-rings 38 is small, the test can be conducted relatively quickly.

Turning now to FIG. 3, there is shown the means for orienting and securably nesting the inner container 12 within the outer container 14. A plurality of holes 66 are drilled through the flange 56 around the circumference thereof. Preferably, the holes 66 will alternate with the holes 61. A corresponding number of holes 67 are likewise drilled into flange 36 so that each of the holes 66 aligns with a hole 67 when the flanges 34, 36 are properly aligned. A plurality of fastening bolts 64 are provided to secure the first or lower inner container part 50 within the first or lower outer container portion 30. A small clearance space is preferably provided between part 50 and portion 30 as best shown in FIGS. 2 and 3. It will be readily appreciated by those skilled in the art that the inner container portion 50 may be securably nested within the outer container portion 30 before either the inner container 12 or the outer container 14 are closed. The lower surface of flange 56 rests on shoulder 48 and is secured thereto with the fastening bolts 64. The inner container part 50 thereby nests within the outer container portion 30.

The upper-surface of flange 36 is provided with a circumferential lip 46 which mates with flange 34 when the outer container 14 is closed. Lip 46 prevents the top outer container portion 32 from shifting relative to the bottom outer container portion 30 during the 30 foot drop test.

Figure 4:
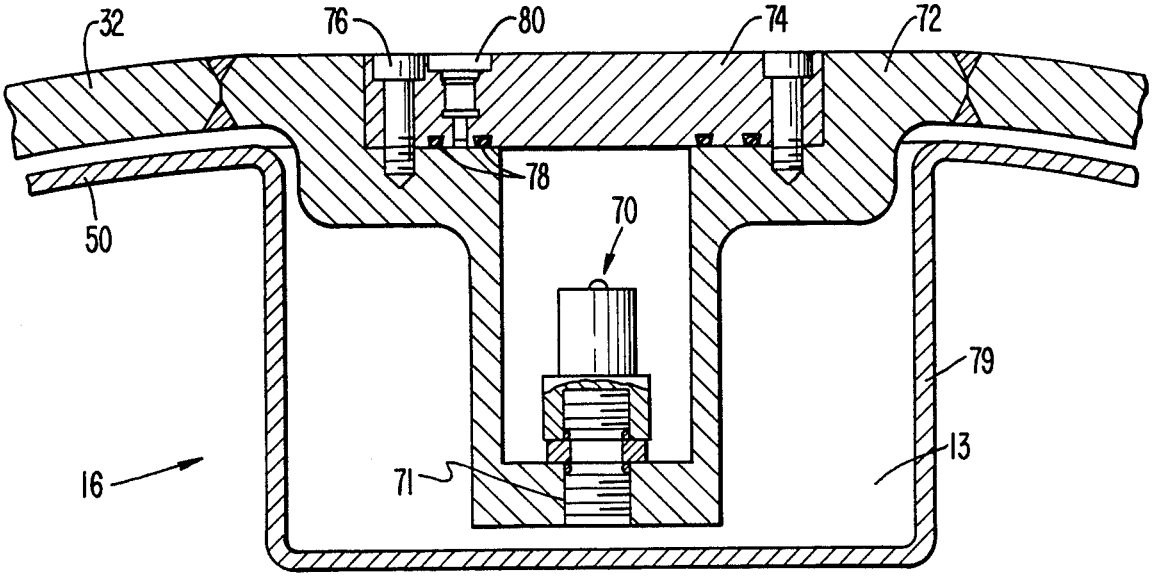
FIG. 4 is a side sectional view of the recessed test port shown in FIG. 1.

Turning now to FIG. 4, there is shown the recessed test port 16. The atmosphere within the enclosed space 13 between the inner and outer containers 12, 14 may be sampled using a sampling connector 70. Sampling connector 70 may be selected from any number of commercial gas sampling connectors. A particular preferred connector is Model No. LL6-K-12 made by Hansen Mfg. Co. in Cleveland, Ohio. Connector 70 is securely fastened within opening 71 provided in the valve mounting support 72. Support 72 may be welded into an opening within the outer container wall. As shown, the valve mounting support 72 has a shape which protrudes inwardly within the outer container 14. Accordingly, the inner container is provided with a recessed portion 79 to accommodate the shape of valve mounting support 72. Recessed portion 79 may have a "squared" shape as in FIG. 4 or a more "rounded" shape as shown in FIG. 1. Since the connector 70 does not provide a leak-tight seal within opening 71, a sealed access plate 74 is provided and secured to mounting support 72 with a plurality of fastening bolts 76. The valve 70 may be accessed by removing the bolts 76 and the plate 74. Two or more O-rings 78 provide an air-tight seal between the access plate 74 and the mounting support 72. A test port 80 is provided to test the integrity of the innermost O-ring 78.

A substantially identical recessed test port (not shown) may also be provided in a wall of inner container 12. This inner container test port has the same construction as test port 16 in the outer container 14. The inner container test port is preferably provided in the dish-shaped end of container part 52 so that the test port can be accessed simply by removing the outer container portion 32. The inner container test port is provided to sample the atmosphere within the closed inner container 12.

Although one embodiment of the shipping container of the present invention has been selected for illustration in the drawings, those skilled in the art will appreciate that equivalent elements may be substituted for the elements specifically illustrated and described herein. The invention is not limited by the detailed description but rather is defined by the appended claims.

I claim:

1. In a shipping vessel for low level radioactive or toxic wastes, said vessel comprising an inner container exhibiting a cylindrical shape and an outer container exhibiting a cylindrical shape, the improvement comprising:

an outer container exhibiting a cylindrical shape and convexly curved ends and having a test port in said outer container communicating with the space between said outer container and said inner container to sample atmosphere within said space;

an inner container exhibiting a cylindrical shape and convexly curved ends, said inner container being nested within and spaced apart from said outer container;

wall materials for said outer container and said inner container being thin enough and deformable enough to absorb the puncturing energy from dropping the vessel from a height of 40 inches onto a 6-inch diameter steel bar by deformation of the outer and inner container walls; and impact absorbers disposed at each end of said outer container, said absorbers comprising a wooden core and a casing around said core.

2. The shipping container of claim 1 wherein said outer container comprises an outer top portion and an outer bottom portion secured together in a leak tight manner.

3. The shipping container of claim 2 wherein said outer top portion and said outer bottom portion exhibit circumferential flanges that are bolted together.

4. The shipping container of claim 3 wherein said inner container comprises an inner top portion and an inner bottom portion secured together in a leak tight manner.

5. The shipping container of claim 4 wherein said inner bottom portion is secured to said outer bottom portion.

6. The shipping container of claim 1 wherein the wall material of said outer container has a thickness of about ½ to 2 inches.

7. The shipping container of claim 1 wherein the wall material for said inner container has a thickness of about ⅛ to 1 inch.

8. The shipping container of claim 1 wherein both the outer container wall material and the inner container wall material are stainless steel.

9. The shipping container of claim 1 wherein the inner container has a recess adjacent the test port of the outer container.

10. The shipping container of claim 1 wherein said wooden core is balsa wood or redwood.

11. The shipping container of claim 1 wherein said inner container exhibits a size and shape sufficient to enclose a plurality of secondary waste containers.

12. The shipping container of claim 11 further comprising means for spacing apart and securably positioning a plurality of said secondary waste containers within said inner container.

13. The shipping container of claim 12 wherein said secondary waste containers are fifty-five gallon drums.

14. The shipping container of claim 1 further comprising a heat shield at least partially surrounding said outer container, said heat shield comprising an insulating layer sandwiched between metallic layers.

15. In a shipping vessel for low level radioactive or toxic wastes, said vessel comprising an inner container exhibiting a cylindrical shape and an outer container exhibiting a cylindrical shape, the improvement comprising:

an outer container exhibiting a cylindrical shape and convexly curved ends and having a test port in said outer container communicating with the space between said outer container and said inner container to sample atmosphere within said space, said outer container comprising an outer top portion and an outer bottom portion secured together in a leak tight manner;

an inner container exhibiting a cylindrical shape and convexly curved ends, said inner container being nested within and spaced apart from said outer container, said inner container comprising an inner top portion and an inner bottom portion secured together in a leak tight manner;

wall materials for said outer container and said inner container being thin enough and deformable enough to absorb the puncturing energy from dropping the vessel from a height of 40 inches onto a 6-inch diameter steel bar by deformation of the outer and inner container walls; and impact absorbers disposed at each end of said outer container, said absorbers comprising a wooden core and a casing around said core.

* * * * *